United States Patent [19]

Greis

[11] Patent Number: 4,463,588

[45] Date of Patent: Aug. 7, 1984

[54] SKEWED-AXIS CYLINDRICAL DIE ROLLING

[76] Inventor: Howard A. Greis, 59 Banbury La., Holden, Mass. 01520

[21] Appl. No.: 360,398

[22] Filed: Mar. 22, 1982

[51] Int. Cl.[3] ..... B21H 3/04

[52] U.S. Cl. ..... 72/98; 72/95; 72/104

[58] Field of Search ..... 72/95, 96, 98, 100, 72/103, 104, 107, 108

[56] References Cited

U.S. PATENT DOCUMENTS

| | | | |
|---|---|---|---|
| 1,367,299 | 2/1921 | Canda | 72/71 |
| 1,901,516 | 3/1933 | Hopkins | 72/100 |
| 2,150,815 | 3/1939 | Berger | 72/100 |
| 4,167,106 | 9/1979 | Berstein et al. | 72/108 |
| 4,170,050 | 10/1979 | Bosse | 72/104 |

FOREIGN PATENT DOCUMENTS

| | | | |
|---|---|---|---|
| 746630 | 8/1952 | Fed. Rep. of Germany | 72/108 |

*Primary Examiner*—Lowell A. Larson
*Attorney, Agent, or Firm*—Charles R. Fay

[57] ABSTRACT

Skewed-axis cylindrical-die rolling system for the production of continuously threaded rod and similar continuous helical forms using two driven forming dies and an annular formed support roller which supports the part being formed a controlled distance below the line of centers of the forming dies.

10 Claims, 3 Drawing Figures

SKEWED-AXIS CYLINDRICAL DIE ROLLING

FIELD OF THE INVENTION

Skewed-axis cylindrical-die rolling for the production of continuously threaded rod and similar continuous helical forms.

BACKGROUND OF THE INVENTION

In the production of continuously threaded rod, studs, or similar helically formed parts, skewed-axis die rolling systems with two dies or three dies having regularly been used. The three-die configuration with three forming dies of the same diameter works well but requires an excessively complex gear box and a complicated and difficult to adjust die support frame. In addition, in a typical skewed axis system, the die diameter and, as a result, the bearings cannot be any larger than approximately five-and-one-half times the root diameter of the work; otherwise, they clash. Furthermore, the same diametral constraints require the mechanism for driving the three dies to be small in diameter, and therefore lacking in torsional strength and rigidity.

The two-die system permits the use of dies of unlimited diameter, within the confine of the machine, and therefore allows for more die regrinds, larger bearings, more robust spindles, and commensurately more rugged die drive mechanisms. In addition, the gear box and die mounting frames are less complicated and therefore less costly to build. However, when through-feed rolling continuously threaded bar, the part being formed has previously been held virtually on centers by input guide tubes, bushings, or a flat carbide work support blade. The tight fitting guide tubes must be changed for each rolling diameter, are difficult to set up, and do not effectively stabilize short, continuously threaded parts in the dies. Furthermore, when not very precisely set in line with the center lines of the dies, or too loose on the blank, they allow the start end of studs or long bars to dive or pop up. This results in deformation of the crests from contact with the input or output guide tubes or bushings, and heavy loads on the starting and finish reliefs of the dies which may accelerate wear and sometimes cause chipping. The use of a smooth carbide blade under the work to support it close to the line of the centers is generally simpler than the use of guide tubes or bushings, but the blades tend to wear and, when they are roughened by this wear, cause deformation of the crests of the part being formed. In addition, if set too low, wear accelerates and the crest deformation gets even worse. On the other hand, if set even slightly too high, the work pops out of the dies causing a possible smashup and other difficulties.

To remedy this situation, the use of a top and bottom blade has been attempted, but this restricts visibility and coolant flow and, with adequate clearances, produces a metastable rolling condition when the work is close to center. In addition, it is costly and difficult to set up and keep a desired adjustment.

All of these conditions are particularly aggravated when rolling stainless steel, hard materials, or other materials which tend to "pickup" on the blade or work support bushing. The present invention eliminates the difficulties involved in the use of guide bushings or flat blades when rolling such work on two-die systems and thereby gives them the rolling advantages of a three-die system without the commensurate disadvantages of high equipment cost, small diameter dies, and relatively weak spindles, bearings, and drives.

SUMMARY OF THE INVENTION

In this invention for rolling helical forms with annular dies on a two-die rolling machine, a third annular freely rotatable roller is used which has a special form such that it supports the part being produced by the dies on the flanks of the threads of the rolled form throughout the full range of contact of the work part with the dies, and also to some degree at the roots of the threads on the workpiece. This support roller does no forming, but although itself formed, only supports the work.

The specially formed support roller is mounted on a vertically and axially adjustable member such that it can hold the workpiece in a position sufficiently below the die line-of-centers so that all possibility of pop-up is avoided, while at the same time it is set high enough so that the downward resultant load from the roll forming force on the work is within the range of readily available antifriction bearings.

By correctly selecting the die roll size, it is possible to form a wide range or workpiece diameters of a given thread form with one support roller and, by adding smooth starting rings at the front of the support roller and the dies, quick pickup and centralization of the part about to be formed is assured. In addition, since the support roller is designed to support the part being formed on the flanks, and at times on the roots, there is no possibility of deformation of the crest of the rolled part as the crests are never in contact with the support roller. Because the rolling action takes place well below die center, the exact height setting for the support roll is not as critical, and therefore the setup process is greatly simplified. In addition, the support roller rotates with the work and it is not apt to pick up or wear, and it furthermore does not use up any significant amount of the horsepower provided for forming, as does a prior art work support blade.

This novel system has other advantages which will become apparent from the description that follows.

PREFERRED EMBODIMENT OF THE INVENTION

Figure 1:
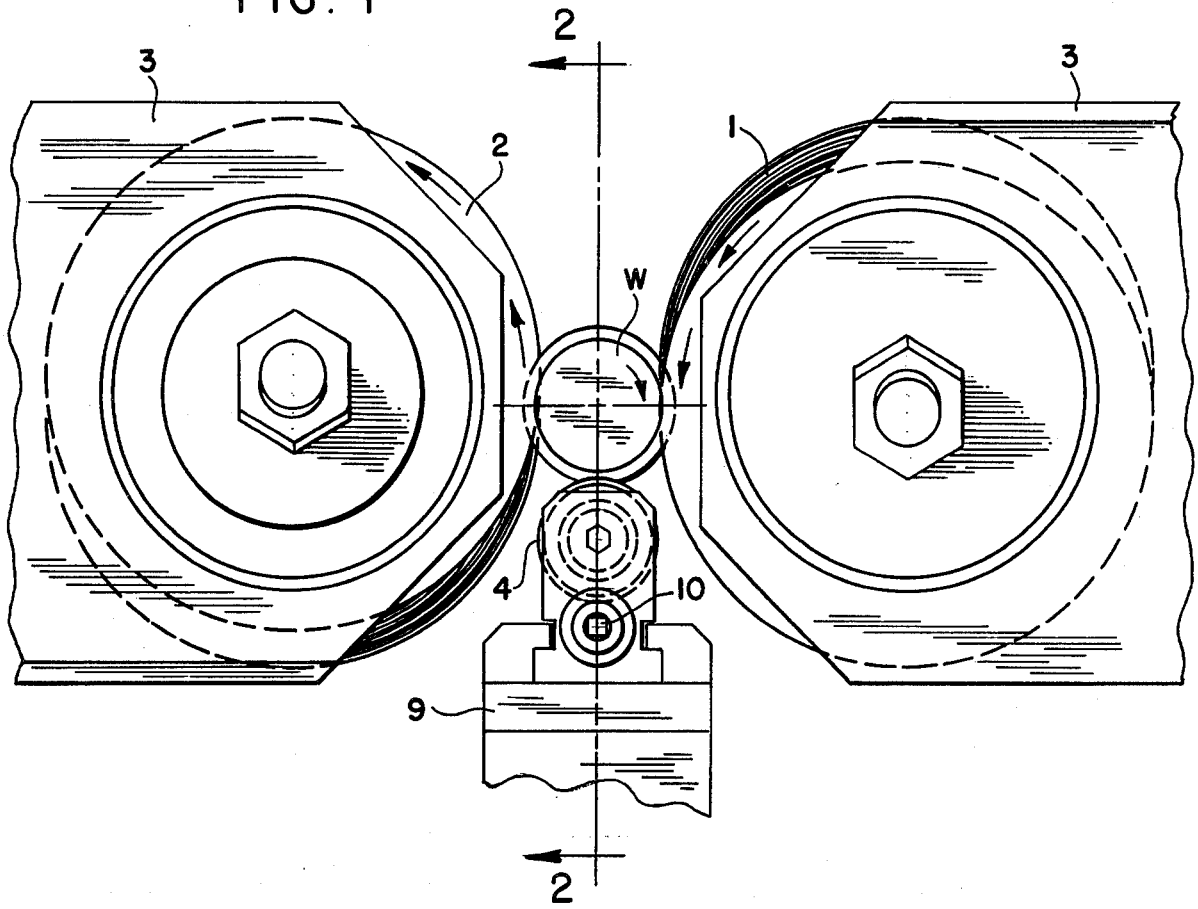
FIG. 1 is a front view of a machine embodying the invention in a skewed-axis two-die rolling machine.

The preferred embodiment of this invention comprises a right annular contoured roll forming die 1 and a left annular contoured roll forming die 2 mounted in a conventional skewed-axis die rolling machine 3. This type of machine is well known, as are the annular dies which are ribbed to cooperatively form a helix on the work W. The dies are skewed relationship to one another so that the ribs on the die will mate with the ribs to be formed on the workpiece W; and the workpiece will have formed on it, as it is passed between the dies, a continuous helical form of constant lead angle. The helical form may be right or left handed and have one or more starts. Located between the dies 1 and 2, with its axis approximately parallel to the axis of the workpiece, is a freely rotatable annular contoured support roller 4. It has a contour that supports the form being rolled primarily on the flanks and the roots of the threads being formed but not on the crests of the threads of the helix being formed. The profile contour has substantially the same shape as that of the right-hand die when it is used to roll a right-hand thread and of the left-hand die when used to roll a left-hand thread.

Figure 2:
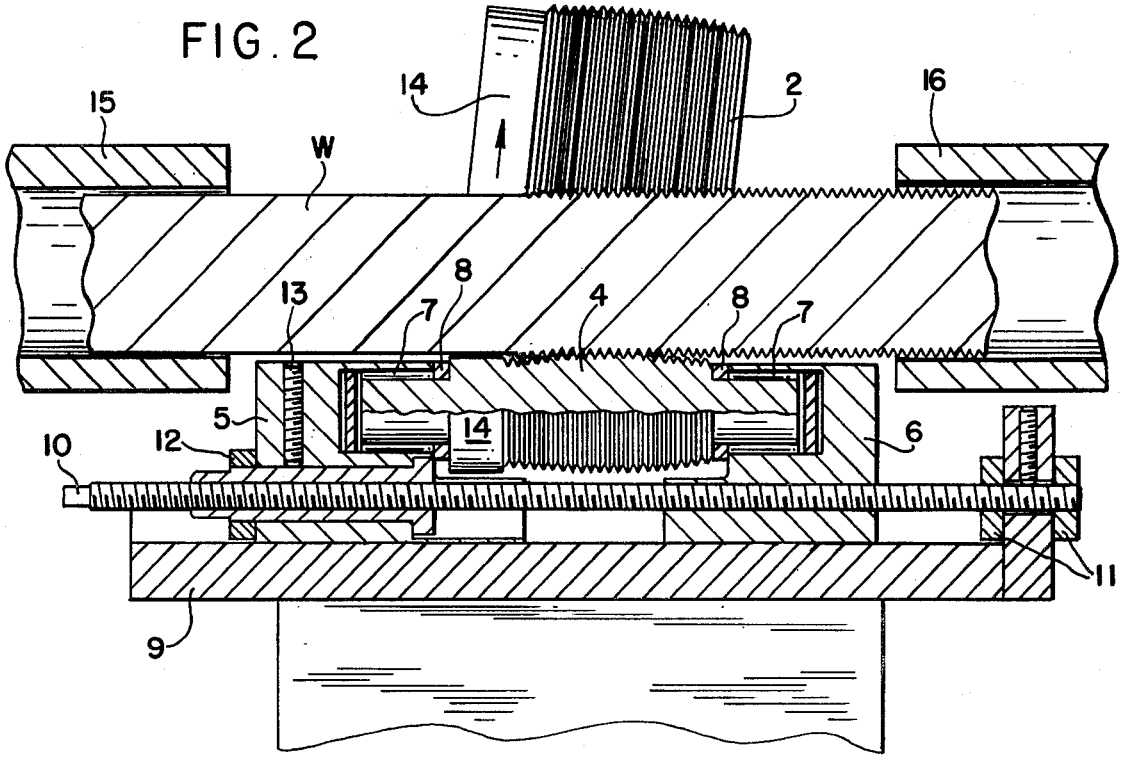
FIG. 2 is a sectional view of the machine of FIG. 1, taken along line 2—2 of FIG. 1.

Preferably, the support roller 4 may be mounted in a front bearing block 5 and a rear bearing block 6, FIG. 2, these bearing blocks being equipped with antifriction roller bearings 7 to carry the downward load, and bronze, or similar metal, thrust bearings 8 to take any axial load. The bearing blocks 5 and 6 are mounted on a baseplate 9 which is, in turn, mounted on either a fixed or adjustable height support, which is a part of a typical die rolling machine, known to the art.

The support roller 4 is located to support the workpiece a distance below the line-of-centers of the dies so that it is impossible for the workpiece to pop up through the die nip during rolling; and yet it is not so far below center that the downward component of the rolling force will cause the support roller to deform the work as it is supporting it. Furthermore, this distance below center will be sufficiently small so that the load on the support roller bearings is small enough to insure long bearing life.

Typically, on die rolling machines whose die diameters are between four and six inches, the distance below centers may be about 3/32 inch. For machines with die diameters of from six to eight inches, it may be approximately ⅛ of an inch. Therefore, the downward load on the support roller typically would be between three percent and seven percent of the combined rolling forces produced by the dies.

The conventional rolling machine normally has an axial matching capability which permits the axial relocation of the right die such that it correctly picks up the track made by the left-hand forming die. The novel support roller herein also requires such a mechanism. In the preferred embodiment this comprises a screw 10 which is freely rotatable with respect to the base plate but axially constrained with respect thereto by members 11 thereon. When this screw is rotated, it moves both bearing blocks 5, 6 axially in unison so as to in turn match the supporting form on the support roller 4 in the correct axial position with respect to the track formed by the right-hand die. It should be noted that the reverse is true when rolling a left-hand form.

In addition, to adjust the gap so that there is limited axial play between the support roller and the two bearing blocks, the front bearing block 5 is fitted with a separate nut 12 which engages the axial adjustment screw 10 and which, when rotated with respect to that screw, moves the front bearing block 5 axially as is required to provide the correct axial play. After that correct axial play is set up and the roller gap adjusting nut 12 locked by a set screw 13 so that it cannot rotate with respect to the front bearing 5, then subsequent rotation of the lead screw permits the above mentioned axial positioning of the support roller 4.

When the dies are correctly matched, a blank is introduced through the front work guide tube 15 into the starting rings 14. The location of the smooth surface of the bottom starting ring on the roller support is such that it correctly guides the blank into the rolling position and when the full form has been created upon the part and it is being supported in the dies, there is a small distance, approximately 0.003 to 0.010 inches between the unformed surface of the workpiece as it enters the die and the top of the support roller 4. This distance is normally about half the total diametral clearance between the unformed workpiece and the I.D. of the input die tube.

As the initial blank enters the space between the die starting rings 14, it is grasped by the starting rings so that it rotates the blank prior to the blank contacting the dies. As the blank enters the dies, they begin to form the helical form on the workpiece, and the forming action continues with the rotation of the dies. As the workpiece goes further and further into the dies, the load created by the rolling action tends to spring the dies open a small amount, and the starting rings in front of the dies leave contact with the unrolled portion of the work. The work continues to be formed, and as it reaches full form, it passes through a dwell section of the die which may be, e.g. of from about 4 to 10 pitches long which insures a straight PD on the part and good roundness to the rolled form. As the completed threaded part leaves the die, it enters an output guide tube 16 which carries the completed bar out of the die gap. With this unique configuration it is possible to run at very high die speeds, and with resultant high thru-feed part production rates, without the risk of unexpected pop-up due to deformations of the bar and similar conditions. Furthermore, as can be seen, since the distance of the center line of the workpiece below the line of centers is not critical, it is easy to set up the dies.

Figure 3:
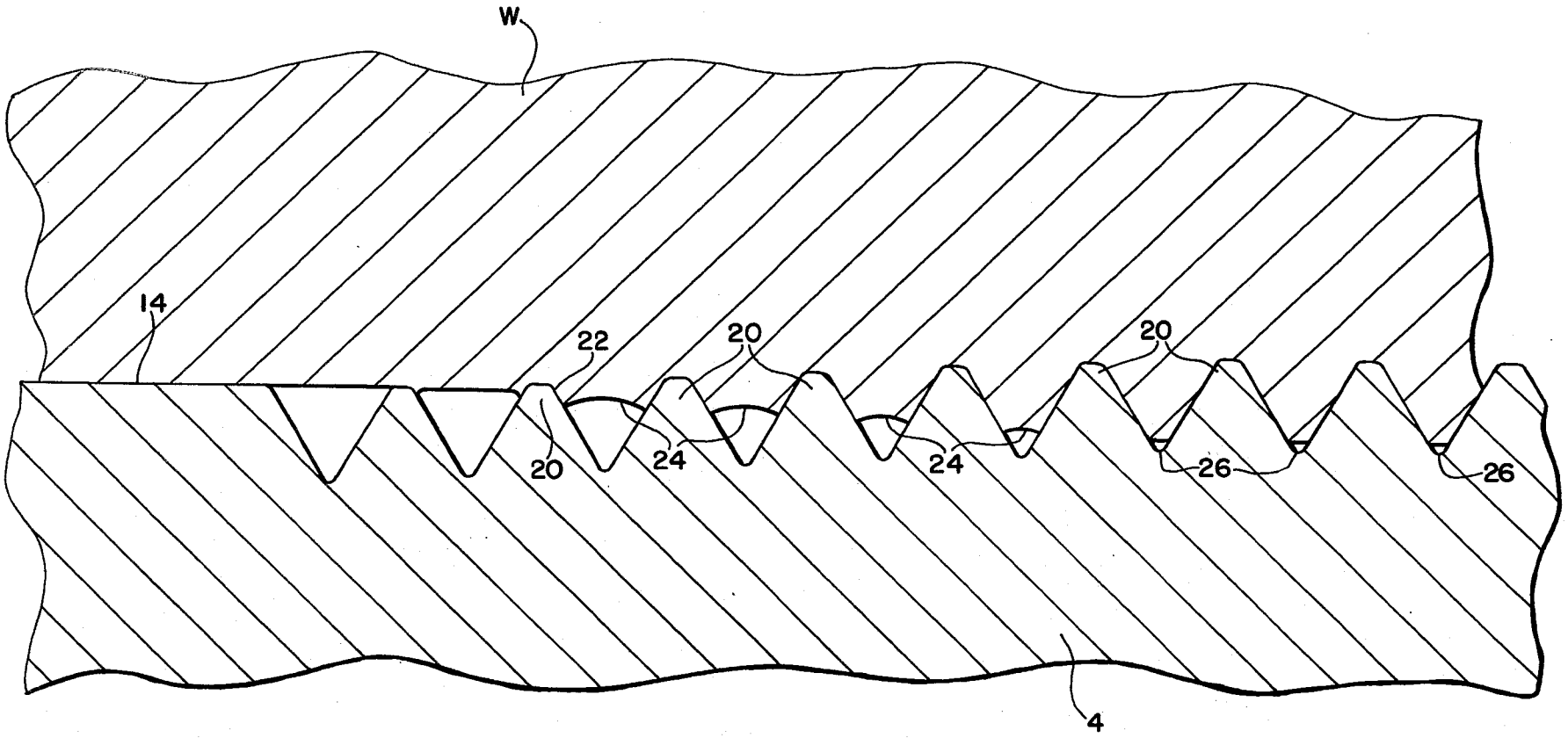
FIG. 3 is an enlarged sectional diagram showing the relation between the work in progress and the formed supporting roller.

With respect to the diagram of FIG. 3, the crests 20 of the work supporting roller 4 enter the gradually forming helix 22 on the work, but the crests 24 being formed do not contact the roots 26 of the supporting roller. The crests of the supporting roller may well contact the helix roots, and the flanks or sides of the helix (threads) and thereby support the work without deformation or scraping of the crests of the work.

I claim:

1. A skewed-axis cylindrical-die rolling machine for the production of continuous helical forms including roots and flanks and comprising at least two driven annular cooperating forming dies and a freely rotatable work support, said support having a formed contour that contacts and supports a significant major portion of the flanks and roots of the threads of the helix being rolled.

2. The rolling machine of claim 1 wherein the support contour includes crests and roots with flanks therebetween conforming to the shape being rolled to fully support the work except at the extreme crests of the threads being formed.

3. The rolling machine of claim 2 wherein the support is located to support the work so that the work axis of rotation is below the line of centers of the dies.

4. A skewed-axis cylindrical-die rolling system for the production of continuous helical forms including roots and flanks and comprising at least two driven annular cooperating forming dies and one freely rotatable formed annular support roller having a contour which contacts and supports a significant major portion of the helical rolled form to support the part being rolled in the rolling position, wherein the contour of the support roller is generally complementary to that of the helical form, including the roots and flanks thereof.

5. The die rolling system of claim 4 wherein the support roller is located to support the work so that the work axis of rotation is below the line of centers of the dies so that the work is prevented from springing away from the roller support and out of the dies.

6. A skewed-axis cylindrical-die rolling system for the production of continuous helical forms comprising at least two driven annular cooperating forming dies and one freely rotatable formed annular support roller having a contour which contacts and supports a significant major portion of the helical rolled form to support the part being rolled in the rolling position, the support roller being located to support the work so that the work axis of rotation is below the line of centers of the dies so that the work is prevented from springing away from the roller support and out of the dies, and the support roller having a partial smooth support surface to guide the unrolled workpiece at the right level into the forming dies, and each forming die has a smooth starting surface in advance of the forming area to grasp the work and prerotate it prior to its entry into the forming dies.

7. The die rolling system of claim 6 including means to support the support roller, said means being axially adjustable with respect to the forming dies.

8. A die rolling system for the production of continuous helical forms comprising at least two driven annular cooperating forming dies and a freewheeling annular supporting roller for the work being formed, the supporting roller having annular ribs formed of alternate crests and roots, the crests conforming to and supporting the roots of the threads of the helix as it is being formed, and the flanks of the ribs progressively conforming to and supporting the flanks of the threads of the helix throughout the full range of contact of the part being formed by the dies.

9. The die rolling system of claim 5 wherein the roots of the ribs of the supporting roller are shaped to fully support the threads of the helix being formed, except at the crests thereof.

10. A die-rolling machine for the production of continuous helical forms comprising at least two driven annular cooperating forming dies and a support for the work being formed, the support being located to support the work so that the work axis of rotation is below the line of centers of the dies, the support including alternate crests and roots, the crests conforming to and supporting the roots of the threads of the helix as it is being formed, and the flanks of the support contour progressively conforming to the flanks of the threads throughout the full range of contact of the support with the part being formed by the dies.

* * * * *